US008482464B2

(12) United States Patent
Wong et al.

(10) Patent No.: US 8,482,464 B2
(45) Date of Patent: Jul. 9, 2013

(54) MOBILE COMMUNICATION DEVICE

(75) Inventors: Kin-Lu Wong, Tapei Hsien (TW); Shu-Chuan Chen, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 614 days.

(21) Appl. No.: 12/761,443

(22) Filed: Apr. 16, 2010

(65) Prior Publication Data

US 2011/0156958 A1 Jun. 30, 2011

(30) Foreign Application Priority Data

Dec. 31, 2009 (TW) ..... 98146591 A

(51) Int. Cl.
*H01Q 1/38* (2006.01)
*H01Q 1/48* (2006.01)

(52) U.S. Cl.
USPC ..... 343/700 MS; 343/845; 343/846

(58) Field of Classification Search
None
See application file for complete search history.

(56) References Cited

U.S. PATENT DOCUMENTS 6,864,841 B2 * 3/2005 Dai et al. ..... 343/700 MS
2003/0063033 A1 * 4/2003 Purr et al. ..... 343/700 MS
2005/0270242 A1 * 12/2005 Qi et al. ..... 343/702

OTHER PUBLICATIONS

"Antenna Frequency Scaling," The ARRL Antenna Book, 1988, pp. 2-24 to 2-25.*

* cited by examiner

*Primary Examiner* — Jacob Y Choi
*Assistant Examiner* — Graham Smith
(74) *Attorney, Agent, or Firm* — Alan Kamrath; Kamrath IP Lawfirm, P.A.

(57) ABSTRACT

A mobile communication device includes a ground plane, a dielectric substrate, and an antenna. The antenna is disposed on one surface of the dielectric substrate and includes a radiating portion, a feeding portion, and a shorting portion. The radiating portion includes a first radiating portion and a second radiating portion. The first radiating portion has at least one bending. One end of the first radiating portion is left open. The second radiating portion is a shunt metal strip. Both ends of the second radiating portion are electrically connected to the first radiating portion such that the second radiating portion forms a closed loop with a segment of the first radiating portion. The feeding portion couples the electromagnetic energy to the radiating portion through a coupling gap, and one end of the feeding portion is the antenna's feeding point. One end of the shorting portion is electrically connected to the radiating portion, and the other end of the shorting portion is electrically connected to the ground plane.

10 Claims, 5 Drawing Sheets

MOBILE COMMUNICATION DEVICE

BACKGROUND OF THE INVENTION

1. Field of the Invention

The present invention relates to a mobile communication device and, more particularly, to a mobile communication device having two wide operating bands.

2. Description of the Related Art

With the fast development of wireless communication technologies, LTE (Long Term Evolution) has emerged as a choice for mobile communication systems and presented challenges of antenna miniaturization to manufacturers. Generally speaking, the operating bandwidth of the antenna used in traditional mobile communication devices is not sufficient for the operating bands of LTE/GSM/UMTS systems. For example, a prior art technique such as Taiwan patent No.I308409, entitled "An Internal Thin Dual-Band Handset Antenna," discloses an antenna design for a slim-type mobile phone. However, the operating band of the antenna can only cover dual-band operations and fails to cover the eight operating bands for LTE/GSM/UMTS. Therefore, it has become a challenge to design an antenna occupying a small space and to provide eight operating bands for the mobile communication device at the same time.

Therefore, it is necessary to provide a mobile communication device and an antenna thereof to solve the problems presented in the prior art techniques.

SUMMARY OF THE INVENTION

It is an object of the present invention to provide a mobile communication device comprising a shorted monopole antenna with a coupling feed. The antenna comprises a radiating portion having a closed loop. The closed loop allows the antenna to generate two wide operating bands, which can cover three operating bands of LTE700/GSM850/900 (698~960 MHz) and five operating bands of GSM1800/1900/UMTS/LTE2300/2500 (1710~2690 MHz) and which are suitable for slim-type mobile communication devices.

In order to achieve the above objects, the present invention discloses a mobile communication device comprising a ground plane, a dielectric substrate, and an antenna. The antenna comprises a first operating band and a second operating band. The antenna is disposed on a dielectric substrate and comprises a radiating portion, a feeding portion, and a shorting portion. The radiating portion comprises a first radiating portion and a second radiating portion. The first radiating portion has at least one bending, and one end of the first radiating portion is left open. The second radiating portion is a shunt metal strip with both ends electrically connected to the first radiating portion. Thus, the second radiating portion forms a closed loop with a segment of the first radiating portion, and the second radiating portion has a length substantially equal to half of a length of the closed loop. In addition, the closed loop has a total length at least equal to one tenth of a wavelength of a center frequency of the first operating band of the antenna. The feeding portion couples the electromagnetic energy to the radiating portion through a coupling gap, which is less than 1 mm, and one end of the feeding portion is the antenna's feeding point. The shorting portion has one end electrically connected to the radiating portion and the other end electrically connected to the ground plane.

DETAILED DESCRIPTION OF THE PREFERRED EMBODIMENTS

The advantages and innovative features of the invention will become more apparent from the following detailed description when taken in conjunction with the accompanying drawings.

Figure 1:
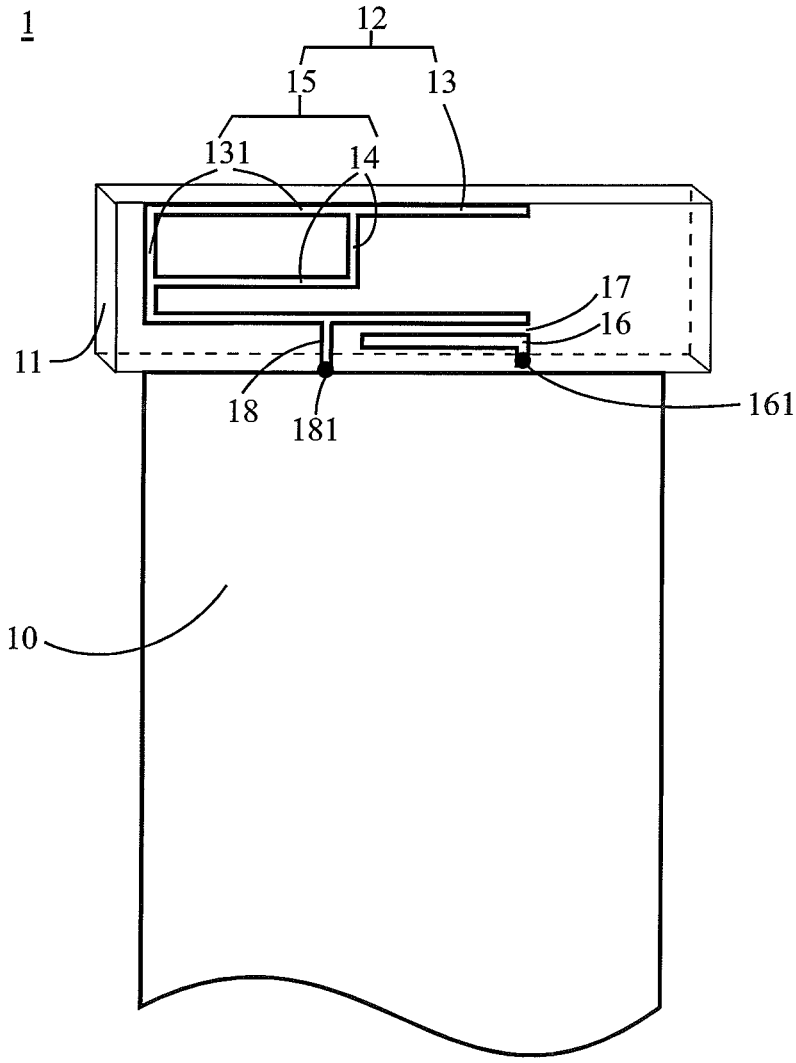
FIG. 1 illustrates a structural view of a first embodiment of a mobile communication device in the present invention.

FIG. 1 illustrates a structural view of a first embodiment of a mobile communication device in the present invention. A mobile communication device 1 comprises a ground plane 10, a dielectric substrate 11, and an antenna, which comprises a first operating band and a second operating band. The antenna is disposed on the dielectric substrate 11 and adjacent to the ground plane 10. The antenna comprises a radiating portion 12, a feeding portion 16, and a shorting portion 18.

In this embodiment, the radiating portion 12, the feeding portion 16, and the shorting portion 18 are on the same surface of the dielectric substrate 11. However, it is noted that the radiating portion 12, the feeding portion 16, and the shorting portion 18 can be on different surfaces of the dielectric substrate 11. For example, when the feeding portion 16 and the radiating portion 12 are on different surfaces of the dielectric substrate 11, while the radiating portion 12 and the shorting portion 18 are on the same surface of the dielectric substrate 11, the antenna can generate a resonant mode around the central frequency of the original resonant mode, although it does require further adjustment for impedance matching.

The radiating portion 12 comprises a bent structure to be compact. The radiating portion 12 comprises a first radiating portion 13 and a second radiating portion 14. Both ends of the first radiating portion 13 are left open. In this embodiment, the first radiating portion 13 comprises two bendings and is formed in a U shape. The second radiating portion 14 is a shunt metal strip (which means the second radiating portion 14 is connected to the first radiating portion 13 in series), having both ends connected to the first radiating portion 13 such that the second radiating portion 14 forms a closed loop 15 with a segment 131 of the first radiating portion 13. The second radiating portion 14 has a length substantially equal to half of a length of the closed loop 15. The closed loop 15 has a total length at least equal to one tenth of a wavelength of a center frequency of the first operating band of the antenna.

The length of the second radiating portion 14 is defined to be half of a length of the closed loop 15. Thus, the second radiating portion 14 can provide a current path similar to that of the first radiating portion 13 to obtain a smoother real/imaginary part impedance response curve for the antenna (not having the second radiating portion 14) around the central frequency of the resonant mode to achieve broadband operation.

Additionally, the total length of the closed loop 15 is at least one tenth of the wavelength of the central frequency of the antenna. The reason is that the second radiating portion 14 provides another current path for the first radiating portion 13. This current path should be long enough to evenly distribute the surface current flowing through the radiating portion 12 of the antenna. In addition, by using the second radiating portion 14, the real/imaginary part impedance response curve for the radiating portion 12 is smoother as compared with that of the prior art, which does not use the second radiating portion. Therefore, the present invention can cover three operating bands of LTE700/GSM850/900 (698~960 MHz) in lower frequencies and five operating bands of GSM1800/GSM1900/UMTS/LTE2300/LTE2500 (1710~2690 MHz) in higher frequencies.

In this embodiment, the closed loop 15 is in a rectangular shape. However, the closed loop 15 can form other shapes, preferably symmetrical shapes.

The feeding portion 16 couples the electromagnetic energy to the radiating portion 12 through the coupling gap 17. The feeding portion 16 has one end that acts as a feeding point 161 of the antenna. The coupling gap 17 is less than 1 mm. The coupling gap 17 is designed to be less than 1 mm to be fit within the whole antenna design structure and to ensure electromagnetic energy coupling with the radiating portion 12. The length and the shape of the coupling gap 17 can be suitably adjusted according to different antenna designs.

One end of the shorting portion 18 is electrically connected to the radiating portion 12, and another end 181 of the shorting portion 18 is a shorting point electrically connected to the ground plane 10.

Figure 2:
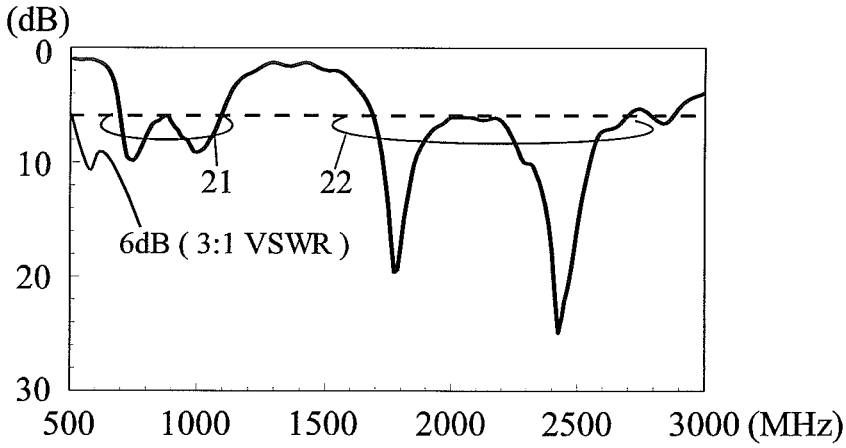
FIG. 2 illustrates a diagram of a measured return loss of the first embodiment of the mobile communication device in the present invention.

Please refer to FIG. 2 for a measured return loss of the first embodiment in the present invention. In the first embodiment, the dielectric substrate 11 is a glass fiber dielectric substrate with a width of 60 mm, a length of 15 mm, and a thickness of 0.8 mm approximately. The radiating portion 12, the feeding portion 16 and the shorting portion 18 are printed or etched on the dielectric substrate 11. The first radiating portion is about 92 mm long, the second radiating portion is about 25 mm long, the feeding portion 16 is about 25 mm long, the coupling gap 17 is about 0.3 mm, and the shorting portion 18 is about 19 mm long.

From the experimental results, with the definition of 6-dB return loss, the bandwidth of the first operating band 21 can cover the three operating bands of LTE700/GSM850/900 (698~960 MHz), and the second operating band 22 can cover the five operating bands of GSM1800/1900/UMTS/LTE2300/2500 (1710~2690 MHz). Therefore, the antenna can cover eight operating bands of LTE/GSM/UMTS.

Figure 3:
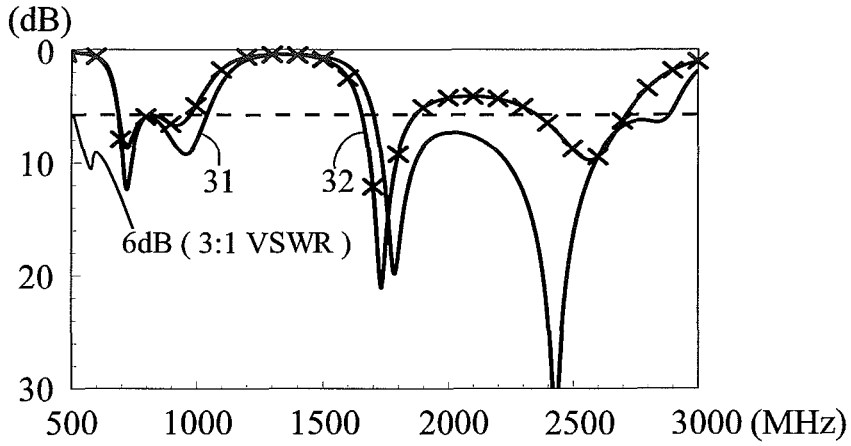
FIG. 3 illustrates a diagram of return loss simulation results of the first embodiment with and without the second radiating portion in the present invention.

Please refer to FIG. 3 for a diagram of return loss simulation results of the first embodiment with or without the second radiating portion 14 in the present invention. From the diagram, it is possible to compare the return loss simulation curve 31 of the first embodiment with the return loss simulation curve 32 of the present invention without the second radiating portion. In FIG. 3, the return loss simulation curve 31 of the first embodiment is a simulation result, and the curve in FIG. 2 represents the measured result. Since these curves present similar results, it can be concluded that the measured return loss curve is quite accurate.

From the return loss simulation results, with the definition of 6-dB return loss, the antenna can generate a wider operating band in the lower frequency range when the second radiating portion 14 is adopted in the first embodiment. The frequency band shown in the return loss simulation curve 31 of the first embodiment can cover the three operating bands of LTE700/GSM850/900 (698~960 MHz). As to the higher frequency range, the antenna comprising the second radiating portion 14 can combine two separate operating bands seen in the antenna without the second radiating portion 14 into one wider operating band, which can cover the five operating bands of GSM1800/GSM1900/UMTS/LTE2300/LTE2500 (1710~2690 MHz).

Figure 4:
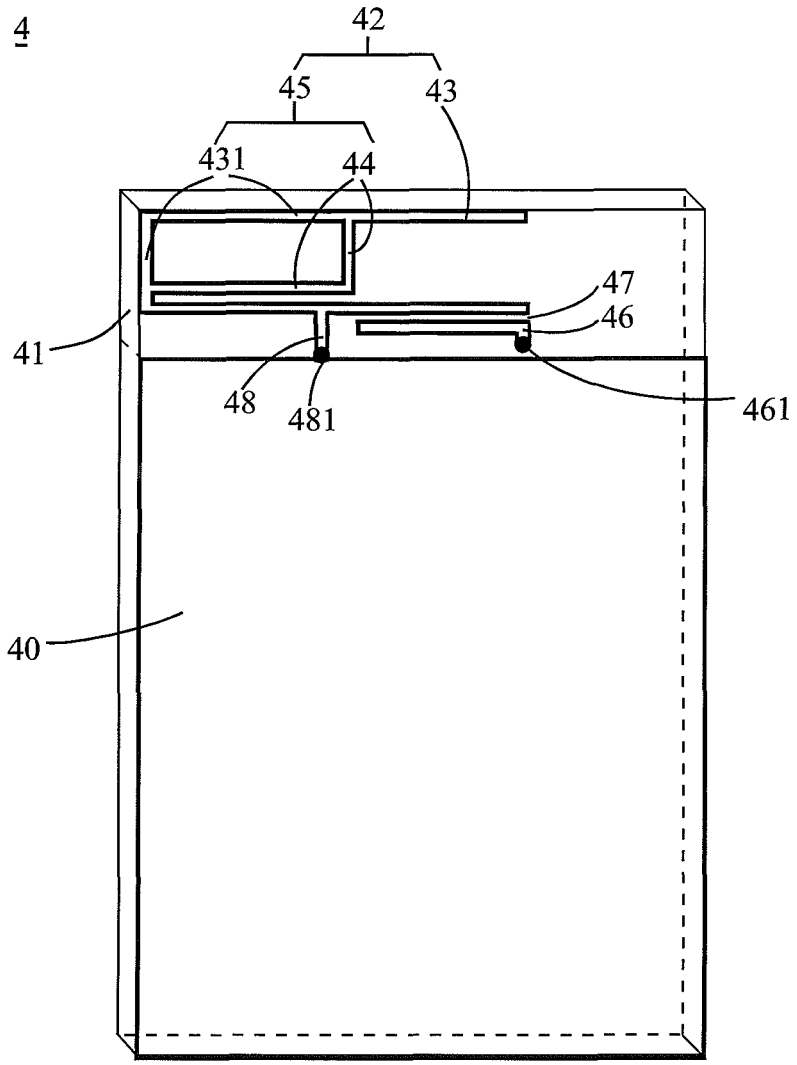
FIG. 4 illustrates a structural view of a second embodiment of a mobile communication device in the present invention.

Please refer to FIG. 4 for a structural view of a second embodiment of a mobile communication device in the present invention. The mobile communication device 4 comprises a ground plane 40, a dielectric substrate 41, and an antenna. The antenna comprises a radiating portion 42, a feeding portion 46, and a shorting portion 48.

The radiating portion 42 comprises a bent structure to be compact. The radiating portion 42 comprises a first radiating portion 43 and a second radiating portion 44. Both ends of the first radiating portion 43 are left open. In this embodiment, the first radiating portion 43 comprises two bendings and is formed in a U shape. The second radiating portion 44 is a shunt metal strip (which means the second radiating portion 44 is connected to the first radiating portion 43 in series), having both ends connected to the first radiating portion 43 such that the second radiating portion 44 forms a closed loop 45 with a segment 431 of the first radiating portion 43.

The feeding portion 46 couples the electromagnetic energy to the radiating portion 42 through the coupling gap 47. The feeding portion 46 has one end that acts as a feeding point 461 of the antenna. The coupling gap 47 is less than 1 mm. One end of the shorting portion 48 is electrically connected to the radiating portion 42, and another end 481 of the shorting portion 48 is a shorting point electrically connected to the ground plane 10.

The structure of the second embodiment differs from that of the first embodiment in the following: The dielectric substrate 41 acts as the system circuit board of a mobile communication system; the ground plane 40 is on a surface of the dielectric substrate 41; the radiating portion 42, the feeding portion 46, and the shorting portion 48 are on a surface of the dielectric substrate 41; and the radiating portion 42, the feeding portion 46, and the shorting portion 48 do not overlap with the ground plane 40. The second embodiment can achieve a result similar to that of the first embodiment.

Figure 5:
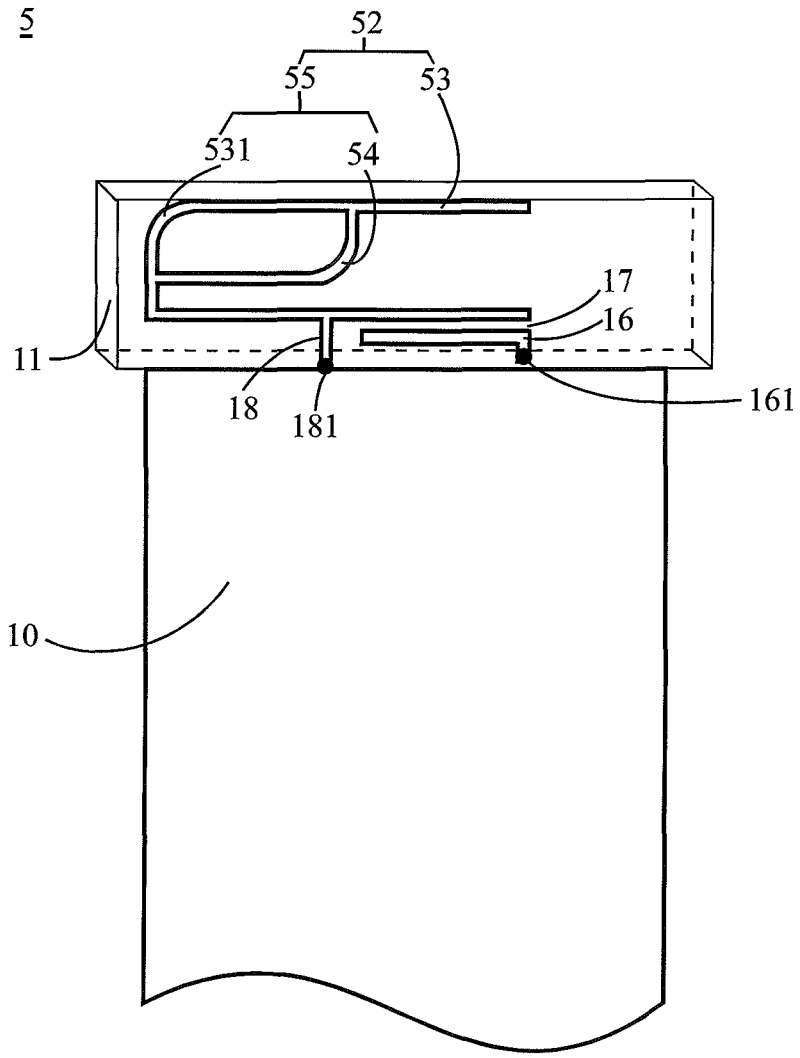
FIG. 5 illustrates a structural view of a third embodiment of a mobile communication device in the present invention.

Please refer to FIG. 5 for a structural view of a third embodiment of a mobile communication device in the present invention. A mobile communication device 5 comprises a ground plane 10, a dielectric substrate 11, and an antenna. The antenna comprises a radiating portion 52, a feeding portion 16, and a shorting portion 18.

The radiating portion 52 comprises a bent structure to be compact. The radiating portion 52 comprises a first radiating portion 53 and a second radiating portion 54. Both ends of the first radiating portion 53 are left open. In this embodiment, the first radiating portion 53 comprises two bendings and is formed in a U shape. The second radiating portion 54 is a shunt metal strip (which means the second radiating portion 54 is connected to the first radiating portion 53 in series), having both ends connected to the first radiating portion 53 such that the second radiating portion 54 forms a closed loop 55 with a segment 531 of the first radiating portion 53.

The structure of the second embodiment is different from that of the first embodiment in that the closed loop 55 can be formed in shapes other than a rectangular shape. In this embodiment, the closed loop 55 is designed to have a smooth curvature (i.e., an arc shape). As long as the second radiating portion 54 has a length substantially equal to half of the length of the closed loop 55, and the total length of the closed loop 55 is at least one tenth the wavelength of the central frequency of the first operating band of the antenna, the third embodiment can achieve a result similar to that of the first embodiment.

Hence, the mobile communication device 1 uses an antenna which can generate two wide operating bands. The antenna uses a shunt metal strip (that is, the second radiating portion 14) to provide another current path for the radiating portion 12 to evenly distribute the surface current flowing through the radiating portion 12. The shunt metal strip is designed to have a length substantially equal to half of the length of the closed loop 15 (such that the shunt metal strip provides a current path similar to that of the radiating portion 12). The total length of the closed loop 15 is at least one tenth of the length of the central frequency of the first operating band of the antenna. Therefore, the closed loop 15 can help the antenna adjust its impedance matching for lower frequency and higher frequency resonant modes to enable operations in a first operating band and a second operating band. The first operating band covers at least the frequency band of 698~960 MHz, and the second operating band covers at least the frequency band of 1710~2690 MHz. Since the first operating band can cover the three operating bands of LTE700/GSM850/900 and the second operating band can cover the five operating bands of GSM1800/1900/UMTS/LTE2300/2500, a mobile communication device using this antenna can provide eight operating bands for covering those frequency bands presently used for wireless mobile communication. Furthermore, the size of the antenna used in the mobile communication device is only about 15×40 mm2, has a simple structure, and is easy to manufacture to meet practical applications.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A mobile communication device comprising:

a ground plane;

a dielectric substrate; and an antenna having a first operating band and a second operating band, with the antenna disposed on the dielectric substrate and comprising:

a radiating portion comprising:

a first radiating portion having a first open end, a second open end, and at least one bend; and a second radiating portion comprising a shunt metal strip with both ends of the shunt metal strip electrically connected to the first radiating portion respectively, wherein the second radiating portion forms a closed loop with a segment of the first radiating portion, with the second radiating portion having a length substantially equal to half of a total length of the closed loop, wherein the closed loop has the total length greater than four-tenths of a length of the first radiating portion;

a feeding portion disposed between the ground plane and the first open end of the first radiating portion and coupling electromagnetic energy to the radiating portion through a coupling gap, with one end of the feeding portion being an antenna's feeding point; and a shorting portion having one end electrically connected to the radiating portion and another end electrically connected to the ground plane, wherein the one end of the shorting portion does not directly connect to the closed loop and is disposed between the closed loop and the first open end of the first radiating portion.

2. The mobile communication device as claimed in claim 1, wherein the first operating band comprises a frequency band of 698~960 MHz, and wherein the second operating band comprises a frequency band of 1710~2690 MHz.

3. The mobile communication device as claimed in claim 1, wherein the ground plane is a system ground plane of a mobile phone.

4. The mobile communication device as claimed in claim 1, wherein the coupling gap is less than 1 mm.

5. The mobile communication device as claimed in claim 1, wherein the radiating portion, the feeding portion, and the shorting portion are on a same surface of the dielectric substrate.

6. The mobile communication device as claimed in claim 1, wherein the dielectric substrate is a system circuit board of a mobile communication system.

7. The mobile communication device as claimed in claim 1, wherein the closed loop is in a rectangular shape or a portion of the closed loop is in an arc shape.

8. The mobile communication device as claimed in claim 1, wherein the at least one bend of the first radiating portion comprises two bends formed in a U shape, and wherein the second radiating portion is in an L shape.

9. The mobile communication device as claimed in claim 1, wherein the ground plane is on a surface of the dielectric substrate.

10. The mobile communication device as claimed in claim 1, wherein the radiating portion, the feeding portion, and the shorting portion do not overlap with the ground plane.

* * * * *